US006253853B1

(12) United States Patent
George

(10) Patent No.: US 6,253,853 B1
(45) Date of Patent: Jul. 3, 2001

(54) FLUID INJECTION TUBING ASSEMBLY AND METHOD

(75) Inventor: Grant E. E. George, Calgary (CA)

(73) Assignee: Stellarton Energy Corporation, Calgary (CA)

( * ) Notice: Subject to any disclaimer, the term of this patent is extended or adjusted under 35 U.S.C. 154(b) by 0 days.

(21) Appl. No.: 09/168,334

(22) Filed: Oct. 5, 1998

(51) Int. Cl.[7] ..... E21B 41/00

(52) U.S. Cl. ..... 166/334.4; 166/316

(58) Field of Search ..... 166/320, 321, 166/323, 334.4, 316; 137/853, 860; 251/127, 324

(56) References Cited

U.S. PATENT DOCUMENTS

| | | | | |
|---|---|---|---|---|
| 1,854,518 | * | 4/1932 | Little | 137/853 |
| 2,275,937 | * | 3/1942 | Baker | 137/853 |
| 2,631,000 | * | 3/1953 | Lee | 166/334.4 |
| 2,855,952 | * | 10/1958 | Tausch et al. | 137/508 |
| 3,815,676 | * | 6/1974 | Read | 166/226 |
| 3,887,007 | * | 6/1975 | Abney et al. | 166/224 A |
| 4,081,028 | * | 3/1978 | Rogers | 166/242 |
| 4,099,563 | * | 7/1978 | Hutchinson et al. | 166/191 |
| 4,399,865 | | 8/1983 | Anderson et al. . | |
| 4,480,695 | | 11/1984 | Anderson . | |
| 4,640,359 | | 2/1987 | Livesey et al. . | |
| 4,919,206 | | 4/1990 | Freeman et al. . | |
| 5,029,644 | * | 7/1991 | Szarka et al. | 166/223 |
| 5,090,481 | | 2/1992 | Pleasants et al. . | |
| 5,211,240 | | 5/1993 | Gadelle et al. . | |
| 5,263,683 | * | 11/1993 | Wong | 166/332 |
| 5,803,177 | * | 9/1998 | Hriscu et al. | 166/305.1 |
| 5,823,254 | * | 10/1998 | Dobson et al. | 166/51 |
| 5,988,285 | * | 11/1999 | Tucker et al. | 166/334.4 |
| 6,044,908 | * | 4/2000 | Wyatt | 166/332.2 |
| 6,059,038 | * | 5/2000 | Vick, Jr. | 166/323 |

* cited by examiner

*Primary Examiner*—David Bagnell
*Assistant Examiner*—Nathan Mammen
(74) *Attorney, Agent, or Firm*—Jeffrey E. Griffin; Jaime A. Castano

(57) ABSTRACT

An injection fluid tubing assembly for handling a flow of fluid [is taught. The assembly] includes tube having a port formed through its wall, a sliding sleeve valve retained within the tube and moveable between a closed position in which it blocks the port and an open position for permitting the flow of fluid to pass through the port and a channel for diverting the flow through the port to prevent the flow from passing directly radially outwardly through the wall of the tube.

24 Claims, 4 Drawing Sheets

FLUID INJECTION TUBING ASSEMBLY AND METHOD

FIELD OF THE INVENTION

The present invention is directed to a well stimulation and production apparatus and method and in particular to an apparatus tubing valve assembly for control of stimulation and production fluids to an oil or gas well and a method for using the assembly.

BACKGROUND OF THE INVENTION

Tubing having openings therein for delivery of stimulation fluids such as, for example, steam to, and for receiving fluids from, a formation are known. Often the openings have removable closures for use during tubing installation. Once the closures are removed, the openings are permanently open.

Recently, a tubing assembly including a sliding sleeve valve has been used in controlling stimulation fluid flow into formations. The tubing assembly includes a sliding sleeve valve positioned over a port through the tubing wall. The sliding sleeve valve is moveable between a closed position, wherein the sleeve blocks the port, and an open position for permitting the flow of the stimulation fluid through the port and to the formation.

Various problems have been encountered by use of the previous sliding sleeve valve tubing assembly. In particular, the stimulation fluid passing through the port tends to cause damage to the formation because of the high pressures of the fluid. In addition, when the sleeve is maintained in the closed position for extended periods, it tends to jam due to a pressure lock and the port tends to become blocked with scale or debris.

The sliding sleeve valves are sometimes used in series along a tubing string in a well. It is intended that the provision of a series of valves will permit stimulation fluid to be delivered along a length of the well. However, it often occurs that the stimulation fluid passes out through the first few valves that it reaches so that the deeper valves transport very little or no stimulation fluid to the formation.

SUMMARY OF THE INVENTION

An injection fluid tubing assembly has been invented which overcomes the disadvantages of injection fluid tubing assemblies. The sleeve valves are useful for placement in series along a length of tubing for use in the injection of stimulation fluid to a formation.

An injection fluid tubing assembly according to the present invention lowers the kinetic energy of and/or diffuses the stimulation fluid prior to releasing it and, thereby, reduces damage to the formation. When application of stimulation fluids to the formation is stopped, the injection fluid tubing can be left in place to act in sand retainment.

In accordance with a broad aspect of the present invention, there is provided an injection fluid tubing assembly for handling a flow of fluid comprising: a tube having a port formed through its wall; a sliding sleeve valve retained within the tube and moveable between a closed position in which it blocks the port and an open position for permitting the flow of fluid to pass through the port; and a flow diverting means in association with the port for diverting the flow of fluid against passing directly radially outwardly through the wall of the tube.

The tube can be any tubular structure suitable for withstanding borehole conditions and for conveying a flow of fluid such as, for example, a stimulating fluid. The tube can be a unitary member or can be formed of a plurality of interconnected parts such as, for example tubing sections and couplings.

The port extends through the wall of the tube to permit stimulating fluid to pass outwardly from the bore of the tube to the outer surface of the tube to, for example, enter a formation. The tube can also be positioned downhole in a producing well and, therefore, the ports can act to permit production fluids to pass from the formation into the tube bore.

A diverting means is provided in association with the port to divert the flow of fluid passing therethrough and to prevent it from passing directly radially outwardly from the bore of the tube. In one embodiment, the diverting means is a wall of the port positioned to divert the flow of fluid to pass through a channel extending substantially longitudinally or substantially circumferentially, relative to the tube, and opening to the outer surface of the tube. There can be one or more channels extending through the tube from the port, as desired. Preferably, the port includes an inner opening from the bore of the tube and an outer opening to the outer surface of the tube and a channel extending between the inner opening and the outer opening. In this arrangement, the wall of the channel acts to divert the fluid through the tube wall. In one embodiment, the channel opens into a header arrangement from which the flow of fluid is divided to pass through a plurality of openings to the outer surface of the tube. Preferably, the plurality of openings cover a large area on the outer surface of the tube. The plurality of openings can be provided, for example, by use of a perforated plate.

In another embodiment, the diverting means is a diffusing material positioned in the port and defining a plurality of tortuous channels through the port. The diffusing material can be for example fibrous material, a slotted plate, or a wire wrapped screen.

In one preferred embodiment, the port includes a longitudinally extending channel which acts to divert the flow of fluid passing through the port and the port further contains a diffusing material, such as a fibrous material or a wire screen, which defines a plurality of tortuous passages through the port.

The sliding sleeve valve is retained within the tube and regulates the flow of fluid through the port. The sliding sleeve valve is moveable between a closed position in which it blocks the port and an open position for permitting the flow of fluid to pass through the port. Any sliding sleeve valve arrangement can be used which permits regulation through the port. in one embodiment, the sleeve valve is formed to permit a reduced flow of fluid through the port when the valve is closed. In other words, a sleeve can be provided which does not completely close off the flow of fluid through the port when the valve is closed. This reduces the chance of a pressure lock and tends to prevent the formation of blockages in the port during periods when the port is closed. In one such embodiment, an opening is formed through the sleeve which is positioned to be in alignment with the port, when the sleeve is in the closed position. The opening is preferably less than 20% of the smallest cross sectional area of the port.

In accordance with another aspect of the present invention, there is provided a method for injecting fluid to a formation comprising: providing a first wellbore into the formation; inserting a tubing assembly into the formation, the tubing assembly including a bore for conveying fluid to the formation, a first port and a second port, the ports opening through the tubing providing access from the bore to the formation and an actuatable valve disposed at each port for regulating the flow of fluid therethrough; providing a second wellbore into the formation, the second wellbore being formed adjacent the first; monitoring wellbore conditions along the second wellbore; and actuating the valves on the tubing assembly to open or close in response to the wellbore conditions.

In a preferred embodiment, the fluid is steam under pressure.

BRIEF DESCRIPTION OF THE DRAWINGS

A further, detailed, description of the invention, briefly described above, will follow by reference to the following drawings of specific embodiments of the invention. These drawings depict only typical embodiments of the invention and are therefore not to be considered limiting of its scope. In the drawings.

DETAILED DESCRIPTION OF THE PREFERRED EMBODIMENTS

Figure 1A:
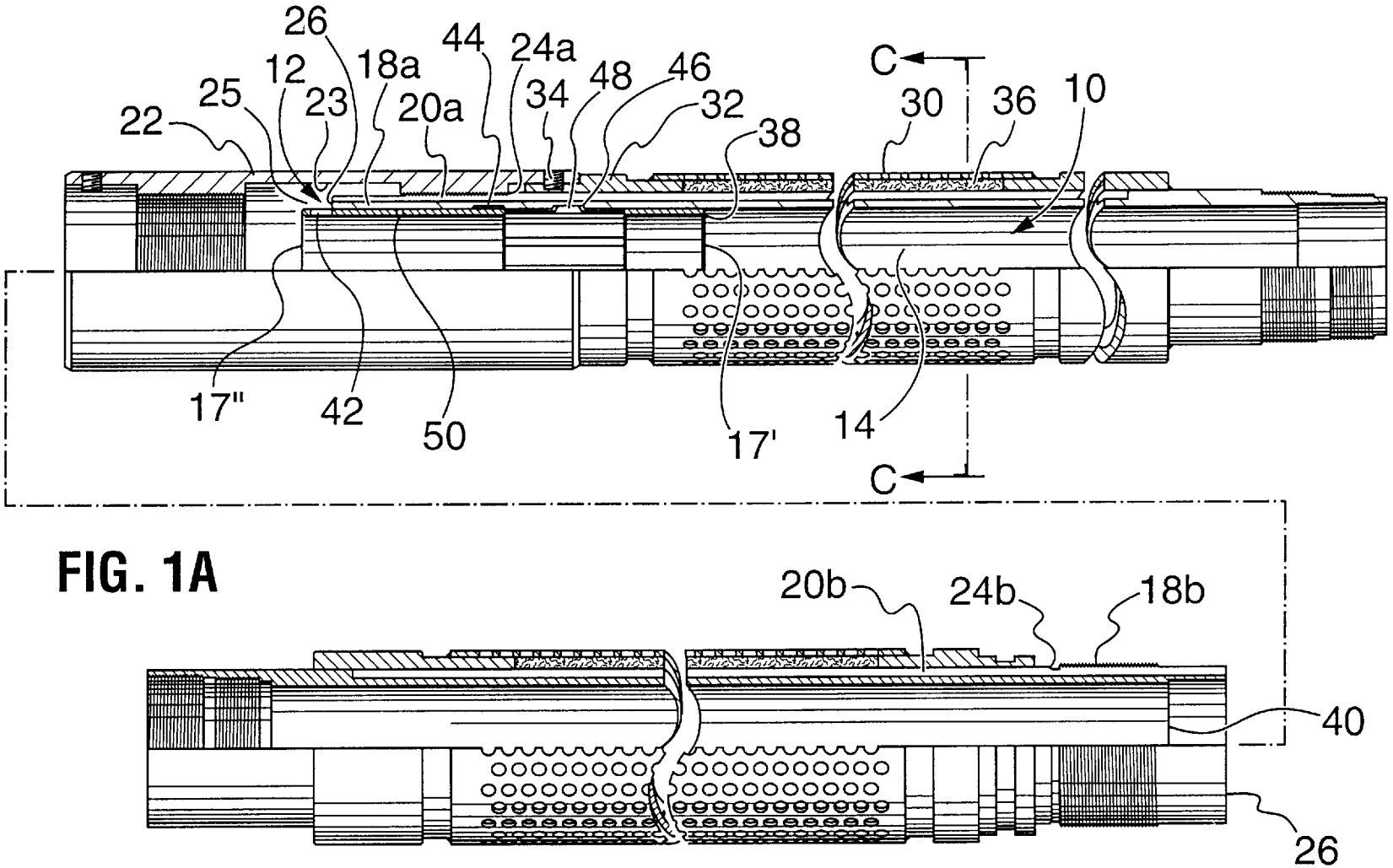
FIG. 1A is front elevation view, partly in longitudinal section, of an injection fluid tubing assembly according to the present invention with the port open.

For the purposes of clarity, in the Figures only reference numerals of the main components are indicated and like reference numerals relate to like components.

Figure 1B:
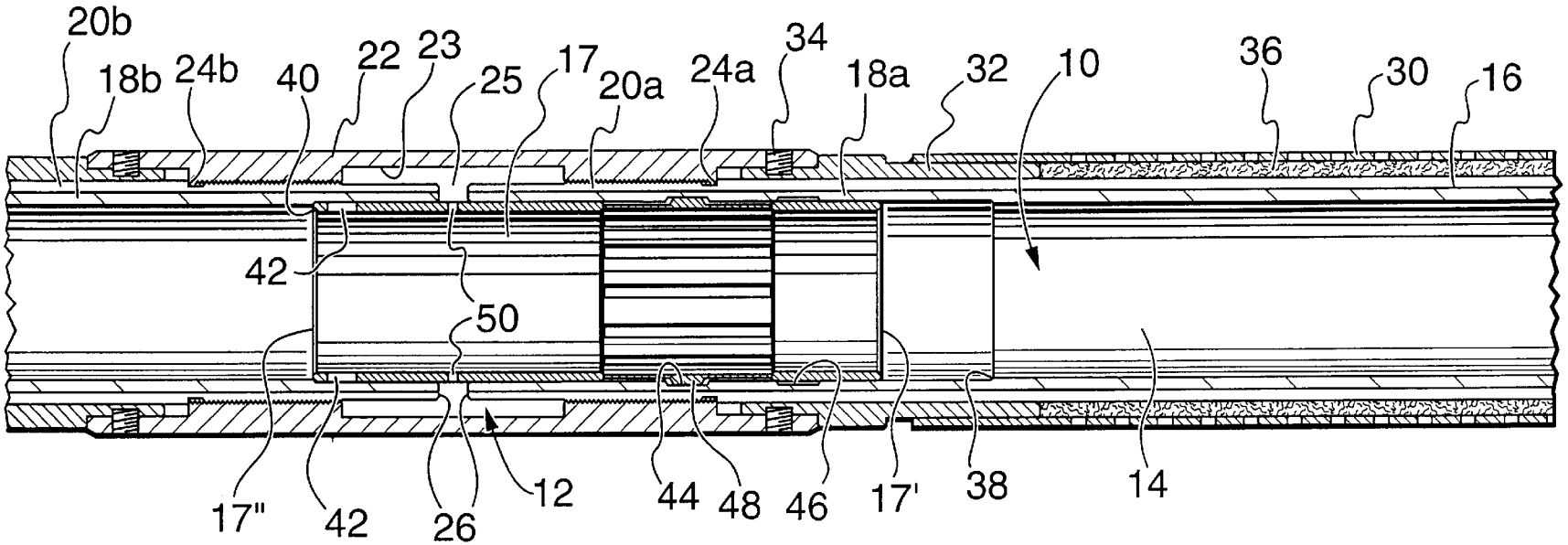
FIG. 1B is a longitudinal section of an injection fluid tubing assembly similar to FIG. 1A, but with the port closed.
Figure 1C:
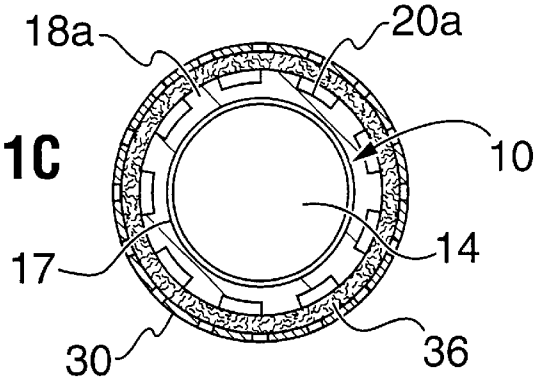
FIG. 1C is a sectional new along line C—C of FIG. 1A.

Referring to FIGS. 1A to 1C, a fluid injection tubing assembly according to the present invention is shown, including a tube 10 having a port 12 extending therethrough between the bore 14 of the tube and the outer surface 16 of the tube. A sliding sleeve valve 17 is positioned in bore 14 of the tube and is moveable between a closed position (FIG. 1B) blocking port 12 and an open position (FIG. 1A) wherein port 12 is uncovered by sleeve valve 17.

To facilitate manufacture, tube 10 preferably includes a plurality of interconnected parts. In the illustrated embodiment, tube 10 includes a first tube 18*a* having longitudinal channels 20*a* formed in the outer surface thereof and a second tube 18*b* also having longitudinal channels 20*b* formed therein. Tubes 18*a* and 18*b* are connected at their ends by a threaded coupling 22 having an inner annular groove 23. Coupling 22 is limited in its threaded advancement over the tubes 18*a*, 18*b* by abutment against shoulders 24*a*, 24*b* formed about the ends of the tubes. This ensures that a space, indicated at 25, remains between the pin faces 26 of tubes 18*a*, 18*b* when the tubes are fully threaded into coupling 22.

Telescopically disposed about each tube 18*a*, 18*b* is an outer perforated sleeve 30. The sleeve is mounted on its tube by any suitable means. In the illustrated embodiment, a ring 32 is mounted about each tube and outer sleeve 30 is secured thereto, as by welding. Ring 32 is engaged to coupling 22 by set screws 34. Contact between coupling 22 and ring can provide a metal to metal seal.

Sleeve 30 is spaced from outer surface 16 of tube 10 such that an annular chamber is formed therebetween. The annular chamber acts as a header, receiving fluid from longitudinal channels 20*a* and distributing it through the plurality of perforations in sleeve 30. The chamber is filled with a diffusing material 36 such as a fibrous material. Diffusing material 36 can be disposed about tube 10 in any suitable way such as, for example, by packing between tube 10 and sleeve 30 or by wrapping about tube 10. Diffusing material 36 is formed of a material capable of withstanding borehole conditions such as, for example, stainless steel. While other diffusing materials can be used, a stainless steel material is preferred having long length fibers of generally ribbon-like shape. Such a steel fibrous material is known as Meshrite™ and is available from Secure Oil Tools Inc., a division of Stellarton Energy Corporation. To prevent diffusing material 36 from moving back into bore 14 of tube 10, an inner perforated sleeve (not shown) can be telescopically positioned between diffusing material and tube 10. The area of the perforated sleeve which provides communication from the annular chamber to the outer surface of the tube is, in the preferred embodiment 2.5 to 3.5 meters in length and extends about the entire circumference of the tube. This provides that the fluids are applied to the formation over a large surface area, rather than being applied through a small number of jet holes. This reduces the damaging effect of any stimulating fluids applied to the formation and increases the amount of formation which is directly contacted by the fluids.

In the illustrated embodiment, port 12 includes space 25, inner annular groove 23, channels 20*a*, 20*b* and the perforations in sleeve 30. Stimulating fluid, such as steam, applied from within the tube can pass through space 25 into annular groove 23, and through channels 20*a* and 20*b*, diffusing material 36 and out through the perforations in sleeve 30. Channels 20*a*, 20*b* are arranged to prevent the stimulating fluids from passing directly radially outwardly from the tube bore to the outer surface of the tube. In particular, channels 20*a* direct the fluids longitudinally through at least a length of the tube wall. This diversion of the stimulating fluid reduces the kinetic energy of the stimulating fluid passing therethrough and reduces damage to the formation as the stimulating fluid passes out of the injection tube. Other port arrangements can be used, as desired.

Sliding sleeve valve 17 is mounted in bore 14 to control flow through port 12. Sleeve valve 17 is mounted in an groove defined between shoulder 38 on tube 18*a* and shoulder 40 on tube 18*b*. The outer diameter of sleeve 17 is just slightly less than the inner diameter of the tube at the groove such that sleeve 17 is slidable within groove until first end 17' of the sleeve valve abuts against shoulder 38 (FIG. 1B) and second end 17" of the sleeve abuts against shoulder 40 (FIG. 1A).

When end 17' abuts against shoulder 38, openings 42 formed through sleeve 17 are aligned with space 25 and, thus, fluids can pass from bore 14 into port 12. It is to be understood that the sleeve could be formed in other ways to open the port. In particular, the sleeve can be shortened such that when the sleeve 17 is abutted against shoulder 38, the sleeve is fully retracted from over space 25. This however, is not preferred since end 17" can become jammed against pin face 26 of tube 18*b*.

To close port 12, sleeve 17 is moved within the groove to abut against shoulder 40. In this position, openings 42 are not aligned with space 25.

A pair of spaced apart annular grooves 44, 46 are formed in the inner surface of tube 18*a* and are adapted to accept and releasably retain protrusions 48 formed on the outer surface of sleeve 17. Protrusions 48 can be formed as a continuous ring or circumferentially spaced discreet protrusions. In the closed position, protrusions 48 extend into groove 44, while in the open position protrusions 48 extend into groove 46. Thus, by interaction of protrusions 48 in grooves 44, 46, sleeve 17 is releasably locked into an open or a closed position. Sleeve 17 is preferably fluted at the position of the protrusions to increase the flexibility of the sleeve at this position and thereby to facilitate movement of the protrusions out of engagement with the grooves.

Longitudinally spaced from openings 42 are openings 50. Openings 50 are spaced from openings 42 a suitable distance such that they will be aligned over space 25 when the sleeve is in the closed position. Thus, openings 50 are spaced from openings 42 a distance substantially equivalent to the space between grooves 44, 46. Openings 50 are between about 5% to 15% of the area of openings 42. In one embodiment, openings 50 have diameters of approximately ⅛" while openings 42 have diameters of approximately ⅜". Openings 50 serve to permit a small amount of stimulating fluid passing though bore 14 to pass through port 12, even when the sleeve is in the closed position. This prevents the sleeve from jamming due to a pressure lock and also prevents the port from becoming clogged with debris or scale.

Figure 2A:
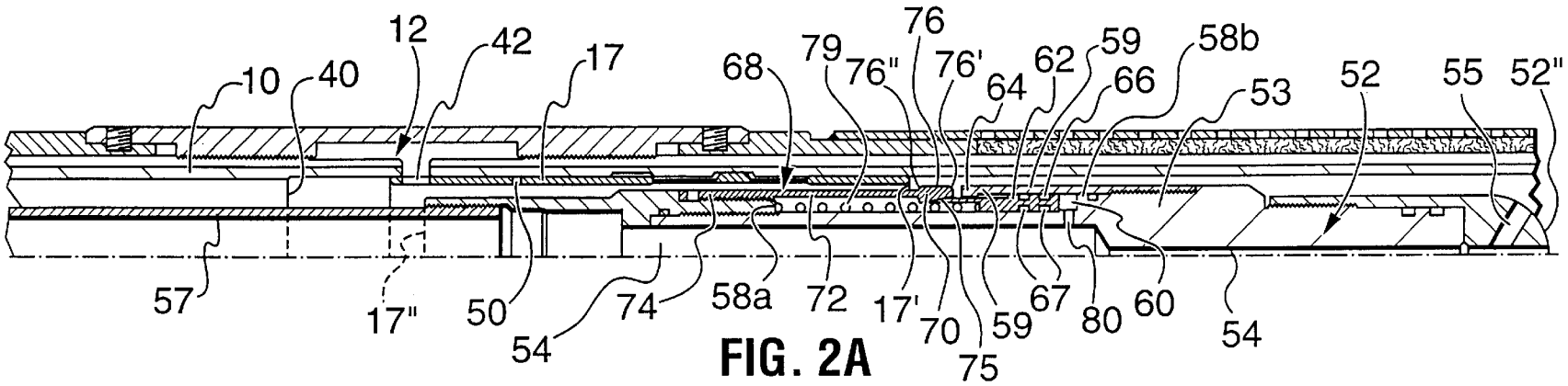
FIGS. 2A and 2B are longitudinal sections along an injection fluid tubing assembly as shown in FIG. 1A with a sleeve shifting tool positioned therein. For simplicity only one half of the assembly is shown, as the other half is a mirror image thereof.
Figure 2B:
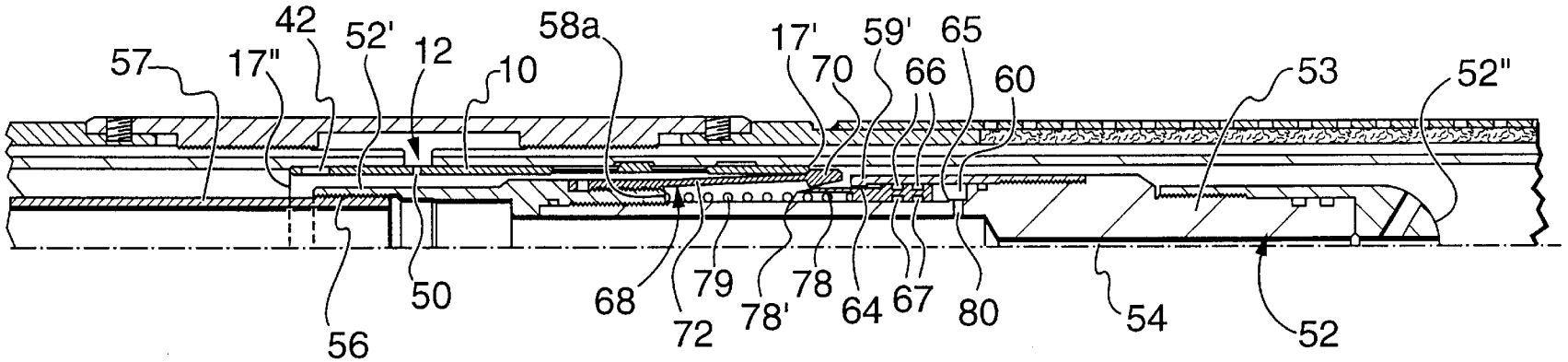

While any tool suitable for the purpose can be used for moving the sleeve between the open position and the closed position, a particularly useful sleeve shifting tool is generally indicated at 52 in FIGS. 2A and 2B. Tool 52 includes a tool body 53 having a central bore 54 extending from the tool's first end 52' to its opposite end 52". Passages 55 can be provided at end 52" to provide communication between bore 54 and the outer surface of the tool. A threaded portion 56 is formed at end 52' into which a pin end of a tubing string 57 is connectable.

Tool body 53 has formed on its outer surface an annular recess defined by shoulders 58*a* and 58*b*. Telescopically disposed about the tool body is a tube 59. Tube 59 at one end is secured by threaded engagement to the tool body to extend out over the recess. The opposite end 59' of the tube is spaced from the tool body and forms an annular chamber 60 therebetween. A ring 62 is disposed in chamber and is slidably moveable therein. A radially inwardly extending protrusion 64 on tube 59 prevents ring 62 from moving out of chamber 60 and a shoulder 65 on tool body 58 prevents movement of ring 62 therepast further into chamber 60. Seals 66, 67, which can be, for example, O-rings, are mounted in ring 62 to provide fluid tight seals between the tube and the ring and the ring and the tool body.

Extending over the recess opposite tube 59 is a plurality of, and preferably four, spring loaded dogs 68. Each spring loaded dog 68 includes a head portion 70 connected to a leaf spring 72. Leaf springs 72 bias the head portions radially inwardly toward tool body 53. Dogs 68 are connected to a single threaded ring 74 for ease of assembly, by threaded connection onto tool body 58. Head portion 70 includes an inner ramped surface 75 and an outer protruding face 76 having an outer shoulder 76' and a base shoulder 76".

Ring 62 includes an annular wall 78 formed to extend out past tube 59. Wall 78 is chamfered at its outer edge 78' to formed a tapered leading edge. A spring 79 is disposed in recess 57 under dogs 68 and extends under wall 78 of ring 62. Spring 79 acts between shoulder 58*a* and ring 62 to bias ring 62 away from shoulder 58*a*.

A plurality of radially extending channels 80 connect between chamber 60 and bore 54 to provide for communication therebetween.

In use, sleeve shifting tool 52 is useful for shifting the sleeve of an injection fluid tubing assembly. The sleeve shifting tool 52 is unset during run in. In the unset position, illustrated in FIG. 2A, spring 79 biases ring 62 away from shoulder 58*a*. Head portions 70 of dogs 68 are biased inwardly against wall 78 of ring 62. The tool is selected such that there is sufficient clearance between head portions 70 and the inner surface of the tubing string, for example tube 10 and sleeve 17 to permit the tool to be run in.

Once the tool is in position adjacent the sleeve which is to be moved, the tubing string is pressured up, as by forcing fluid through tubing string 57 and into bore 54. The pressurizing fluid can pass through passages 55 and act in a jetting operation to remove debris from a region of the tubing string. The pressurizing fluid also moves from bore 54 of the tool and out through channels 80 into chamber 60. This causes the pressure in chamber 60 to be greater than the pressure around the tool. Thus, ring 62 is driven outwardly from chamber 60. This drives wall 78 against ramped surfaces 75 of dogs 68 to urge them radially outwardly. By this action, outer protruding faces 76 extend out a sufficient distance such that their base shoulders 76" can latch against end 17' of the sleeve (FIG. 2B). The sleeve is then moved by pulling the tubing string 57 and attached tool 52 towards surface. Once sleeve 17 abuts against shoulder 40 of tube 18*b*, the sleeve can be moved no further. This is detectable at surface by an increase in load on the tubing string. The tubing string can then be de-pressurized to permit the dogs to be biased back in against the tool body and out of engagement with the sleeve.

While the tool illustrates the movement of the sleeve to a closed position, it is to be understood that the tool can also be used to return the sleeve to an open position. This is done by reversing the orientation of the tool so that threaded portion 56 is adjacent the channels 80 rather than the ring 74.

Figure 3:
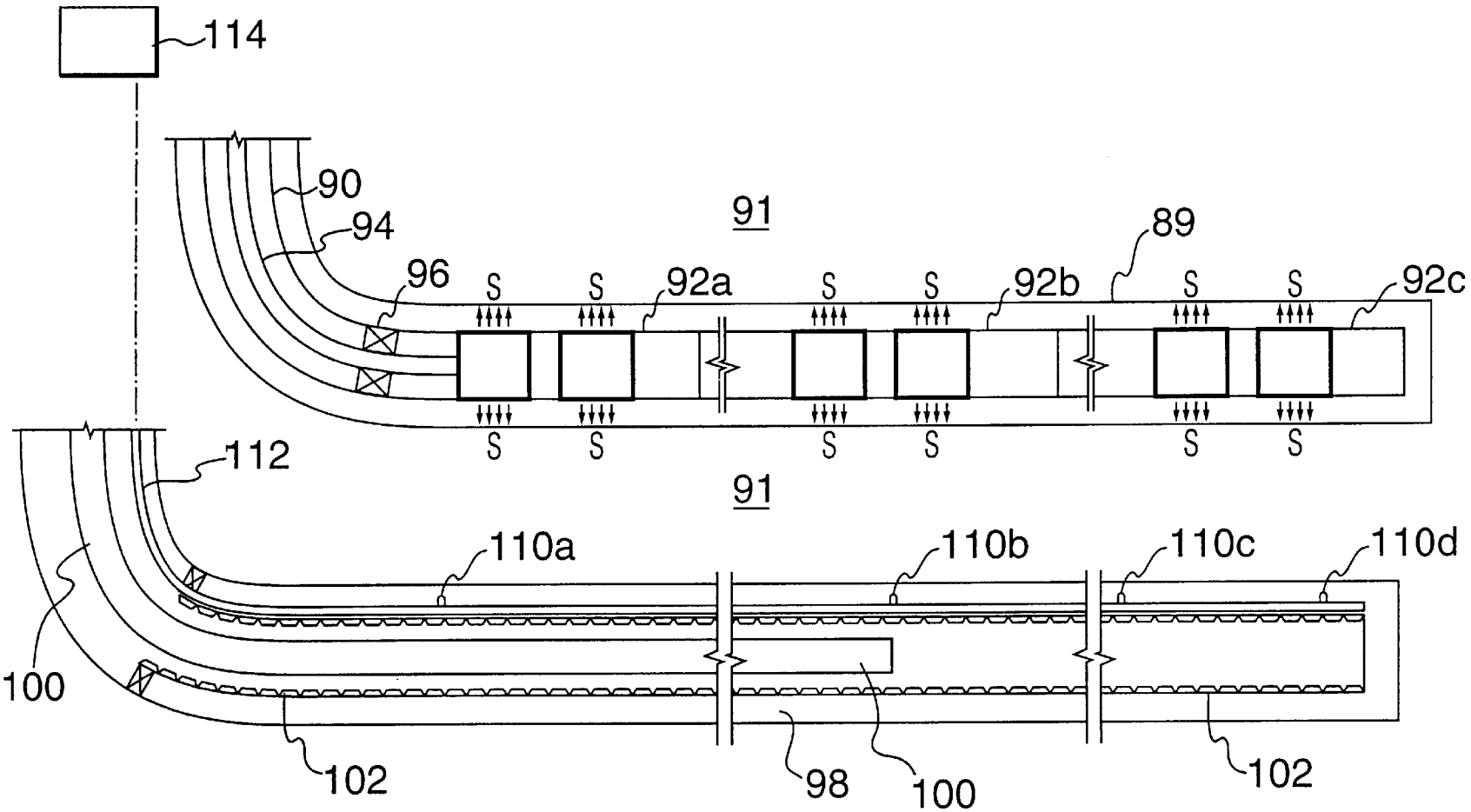
FIG. 3 is a schematic view of a injection fluid tubing string positioned in a stimulation well to act on a formation containing an adjacent production well.

In use in the stimulation of a underground formation, a plurality of injection fluid tubing assemblies, such as the one shown in FIG. 1A, are connected in series into a tubing string. Referring to FIG. 3, a borehole 89 containing a tubing string, generally indicated as 90, for use in the stimulation of an underground formation 91 is shown. String 90 includes three spaced apart injection fluid tubing assemblies 92*a*, 92*b*, 92*c* and a tubing string 94 passing to surface. An amount of stimulating fluid such as, for example, steam under pressure is fed to the string by tubing string 94. When the sleeves of the tubing assemblies are open, the stimulating fluid passes out through the ports of the assemblies into the formation, as indicated by the arrows s. In a preferred embodiment, the tubing assemblies 92*a*, 92*b*, 92*c* are spaced apart a distance of about 100 meters. A wellbore isolating means, such as packer 96, is positioned to confine the stimulating fluid to a selected portion of the tubing string 90.

The stimulating fluid which is being passed through tubing string 90 stimulates production of hydrocarbon fluids, such as oil, from formation 91. Another borehole 98 containing tubing string 100 is positioned to extend proximate tubing string 90. Borehole 98 should be sufficiently proximal to borehole 89 such that stimulating fluids injected through borehole 89 can have an effect on the production through borehole 98. Tubing string 100 collects and conveys the produced fluids to surface. Tubing string 100, in the illustrated embodiment is position with its end within slotted liner 102. Other borehole assemblies can be used, as desired, for collection of produced fluids.

A plurality of sensors 110*a*–110*d* are positioned within borehole 98 to sense conditions along the borehole within the producing formation. Sensors 110*a*–110*d* are positioned at known locations along borehole 98 and it is preferred that it is know which of the sensors are closest to each of injection fluid tubing assembly 92*a*, 92*b*, 92*c*. As an example, according to the method of the present invention, in the illustrated embodiment, it is determined that: sensor 110*a* is closest to injection fluid tubing assembly 92*a*; sensor 110*b* is closest to injection fluid tubing assembly 92*b*; and sensors 110*c*, 110*d* are injection fluid tubing assembly 92*c*. Sensors 110*a*–110*d* are connected to surface by transmission line 112.

A monitoring system such as a computer 114 is connected to line 112 to receive signals from sensors 110*a*–110*c*.

Signals representative of, for example, temperature and/or pressure are useful indicators of borehole conditions and can represent the status of the formation stimulation process. Based on the received signals decisions can be made as to whether certain of the fluid delivery ports of the injection fluid tubing assemblies should be opened or closed. As an example, where steam is used as the stimulating fluid and the temperature at one sensor, for example 110*a*, begins to increase at a greater rate than the other sensor 110*b*–110*d* closest to other injection fluid tubing assemblies, it is known that the stimulating fluid is passing from injection fluid tubing assembly 92*a* through the formation at a greater rate than from the other tubing assemblies 92*b*, 92*c*. Thus, injection fluid tubing assembly 92*a* can be shut (as in FIG. 1A) to prevent formation damage, as by channeling.

The sensors can be any suitable means for sensing downhole conditions. In a preferred embodiment, thermal couples are used and are in communication with a surface monitoring means such as a computer.

It will be apparent that many other changes may be made to the illustrative embodiments, while falling within the scope of the invention and it is intended that all such changes be covered by the claims appended hereto.

What is claimed is:

1. An injection fluid tubing assembly for handling a flow of fluid comprising: a tube having a port formed though its wall; a sliding sleeve valve retained within the tube and moveable between a closed position in which it blocks the port and an open position for permitting the flow of fluid to pass through the port; and a flow diverter comprising a diffusing material having one or more tortuous paths in communication with the port for diverting the entire flow of fluid against passing directly radially outwardly through the wall of the tube.

2. The injection fluid tubing assembly as defined in claim 1 wherein the diverter further comprises a channel extending substantially longitudinally relative to the tube in communication with the port, the channel adapted to receive fluid from the port.

3. The injection fluid tubing assembly as defined in claim 1 wherein the diverter comprises a plurality of channels extending from the port.

4. The injection fluid tubing assembly as defined in claim 1 wherein the diverter comprises a channel extending substantially circumferentially relative to the tube in communication with the port.

5. The injection fluid tubing assembly as defined in claim 1 wherein the diffusing material comprises a fibrous material.

6. The injection fluid tubing assembly as defined in claim 1 wherein the diffusing material comprises a slotted plate.

7. The injection fluid tubing assembly as defined in claim 1 wherein the diffusing material comprises a wire wrapped screen.

8. The injection fluid tubing assembly as defined in claim 1, the sliding sleeve valve being adapted to permit a reduced flow of fluid through the port when the sliding sleeve valve is in the closed position.

9. The injection fluid tubing assembly as defined in claim 1 wherein an opening is formed thought the sliding sleeve valve, the opening being positioned to be out of alignment with the port when the sliding sleeve valve is in the closed position.

10. The injection fluid tubing assembly as defined in claim 9, wherein the opening is less than 20% of the smallest cross sectional area of the port.

11. The injection fluid tubing assembly as defined in claim 1, wherein the sliding sleeve valve includes an opening extending therethrough for alignment with the port, when the sliding sleeve valve is in the open position.

12. The injection fluid tubing assembly as defined in claim 1 wherein the assembly is connectable to a conduit string.

13. An apparatus for injecting fluids into a well, comprising:

a conduit having at least one port, the conduit to carry injected fluid;

a valve adapted to be moveable between an open position and a closed position relative to the at least one port; and a diverter mechanism comprising:

at least one flow channel in communication with the port and adapted to divert substantially the entire flow of fluid against passing directly radially outwardly from the conduit, and an outer sleeve attached to the conduit and having plural radial openings to enable flow of the injected fluid from the at least one flow channel to a region outside the apparatus, at least two of the radial openings being spaced apart along an axial axis of the sleeve.

14. The apparatus of claim 13, further comprising an attachment mechanism adapted to attach the sleeve to the conduit.

15. The apparatus of claim 13, wherein the diverter mechanism further comprises a chamber containing a diffusing material through which injected fluid is to be passed.

16. The apparatus of claim 13, further comprising a shifting tool to operate the valve.

17. The apparatus of claim 16, wherein the shifting tool comprises a pressure-responsive element to engage the valve.

18. The apparatus of claim 17, wherein the pressure-responsive element comprises a chamber to receive fluid pressure communicated through the conduit.

19. The apparatus of claim 13, wherein the at least one flow channel extends generally longitudinally along an axial axis of the apparatus.

20. The apparatus of claim 13, wherein the conduit comprises a tube.

21. The apparatus of claim 20, wherein the at least one flow channel extends longitudinally outside the tube.

22. The apparatus of claim 20, wherein a chamber is formed between the sleeve and the tube, the at least one flow channel leading to the chamber.

23. An injection fluid assembly comprising:

a conduit having at least one port formed through its wall;

a valve moveable between a closed position to block the at least one port, and an open position to permit the flow of fluid through the at least one port; and a flow diverter comprising a fibrous diffusing material to divert substantially the entire flow of fluid against passing directly radially outwardly from the conduit.

24. An apparatus for injecting fluids into a well, comprising:

a conduit having at least one port, the conduit to carry injected fluid;

a valve adapted to be moveable between an open position and a closed position relative to the at least one port; and a diverter mechanism comprising:

at least one flow channel in communication with the at least one port to divert a flow of fluid against passing directly radially outwardly from the conduit, and an outer sleeve attached to the conduit and having plural radial openings to enable flow of the fluid from the at least one channel to a region outside the apparatus, at least two of the radial openings being spaced apart along an axial axis of the apparatus; and the at least one port being offset from the plural openings along the axial axis of the apparatus.

* * * * *